US010031486B2

(12) United States Patent
Poguntke

(10) Patent No.: US 10,031,486 B2
(45) Date of Patent: Jul. 24, 2018

(54) METHOD OF ACTUATOR NAVIGATION AND ELECTRONIC DEVICE COMPRISING AN ACTUATION NAVIGATOR FUNCTION

(71) Applicant: Timex Group USA, Inc., Middlebury, CT (US)

(72) Inventor: Felix Poguntke, Karlsruhe (DE)

(73) Assignee: Timex Group USA, Inc., Middlebury, CT (US)

( * ) Notice: Subject to any disclaimer, the term of this patent is extended or adjusted under 35 U.S.C. 154(b) by 0 days.

(21) Appl. No.: 15/459,126

(22) Filed: Mar. 15, 2017

(65) Prior Publication Data

US 2017/0269555 A1 Sep. 21, 2017

Related U.S. Application Data

(60) Provisional application No. 62/390,025, filed on Mar. 16, 2016.

(51) Int. Cl.

| | |
|---|---|
| ***G04C 3/14*** | (2006.01) |
| ***G04G 5/04*** | (2006.01) |
| ***G04B 19/04*** | (2006.01) |

(52) U.S. Cl.

CPC ..... *G04G 5/04* (2013.01); *G04B 19/04* (2013.01); *G04C 3/14* (2013.01)

(58) Field of Classification Search

CPC ..... G04B 19/04; G04B 19/241; G04C 3/001; G04C 3/14; G04C 9/00; G04G 5/04

See application file for complete search history.

(56) References Cited

U.S. PATENT DOCUMENTS

| | | | | |
|---|---|---|---|---|
| 5,959,941 | A * | 9/1999 | Murakami | G04F 8/00 368/110 |
| 6,490,230 | B1 * | 12/2002 | Sakuyama | G04C 3/14 368/11 |
| 7,258,481 | B2 | 8/2007 | Zachmann | |
| 7,420,880 | B2 | 9/2008 | Burkhardt et al. | |
| 7,778,116 | B2 | 8/2010 | Maeder | |
| 2005/0122845 | A1 | 6/2005 | Lizzi | |
| 2006/0133216 | A1 * | 6/2006 | Zachmann | G04C 3/146 368/80 |
| 2009/0015514 | A1 * | 1/2009 | Suzuki | B63C 11/02 345/3.1 |
| 2015/0277387 | A1 * | 10/2015 | Hasegawa | G04G 9/00 368/239 |
| 2016/0299471 | A1 * | 10/2016 | Nagahama | G04B 19/04 |

* cited by examiner

*Primary Examiner* — Vit W Miska
(74) *Attorney, Agent, or Firm* — Carmody Torrance Sandak & Hennessey LLP

(57) ABSTRACT

A method of setting/calibrating a feature or function in a setting/calibrating mode of an electronic device comprising at least one actuatable selector, wherein the setting/calibrating of the feature or function requires an actuation of the at least one selector, wherein the electronic device comprises at least one indicator hand coupled to an actuation mechanism that rotates the at least one indicator hand in at least one of a clockwise and counterclockwise direction, wherein the method comprises the steps of using the at least one indicator hand to indicate the actuatable selector for actuation; setting/calibrating the feature or function; and exiting the setting/calibration mode. An electronic device that carries out the foregoing method is also disclosed.

8 Claims, 13 Drawing Sheets

METHOD OF ACTUATOR NAVIGATION AND ELECTRONIC DEVICE COMPRISING AN ACTUATION NAVIGATOR FUNCTION

BACKGROUND OF THE INVENTION

The present invention is directed generally to electronic devices that provide for the setting and/or calibrating of a feature and/or function, and in particular, to an improved methodology for the setting/calibrating a feature or function in a setting/calibrating mode of an "analog type" electronic device, in which an indicator hand is used to guide the user as to which pusher(s)/selector(s) is/are needed to be actuated to effectuate the setting/calibrating of the feature and/or function. An electronic device that carries out the foregoing method is also provided.

Ideas to assist users in setting and/or calibrating a feature and/or function in an electronic device, such as a wristwatch, are broad and varied. For example, in watches commonly referred to as "digital" watches, actual printed text may be provided along the bezel of the device (or on the display itself) to prompt users through a setting and/or calibration sequence.

In "analog" watches, the idea of printing on the watch bezel is often times less than desirable, and may even be less than practical since limited information can be provided on the bezel itself while still remaining aesthetically pleasing. Therefore, a perceived deficiency in the prior art is the ability to provide a user with easy to remember steps for setting/calibrating a feature or function in an electronic device of the "analog" type.

Further compounding this difficulty is the fact that users may not understand (or remember) the sequences of pusher actuations (or steps) for setting or calibrating a particular feature or function in such an "analog" type electronic device. That is, it is a perceived difficulty to require users to read and/or remember the required sequence of steps to achieve a particular setting or calibration of a feature or function in the device, and it is difficult to expect users to read and/or remember such a setting or calibrating sequence (i.e. what actuators to push, when to push them and/or in what order they are to be actuated).

At least one successful attempt has been made at overcoming the foregoing deficiency. Specifically, U.S. Pat. No. 7,258,481 describes, among other things, a method of indicating which hand is next for setting/calibrating by causing said hand to "waggle" (e.g. rotating slightly CCW (or CW) and then in the opposite CW (or CCW) direction)) thereby in effect telling the user, "Hey, I am the next hand ready for setting/calibration." By this method, the electronic device assists in "walking" the user through a setting/calibration sequence by letting the user know which hand is next for setting/calibration.

Notwithstanding the foregoing, it is believed that further advances in the art are both desirable and achievable. For example, there is still a need in the art to overcome the aforementioned deficiencies of having to require a user to read, understand, remember and/or recall a user actuation sequence in the context of setting and/or calibrating a feature or function in an electronic device in which one or more actuations of a pusher/selector is/are required. In addition, there is a need to provide users with a method of more easily carrying out a sequence of pusher/selector actuations in order to set/calibrate a feature or function in an "analog type" electric device. Further, there is a need to provide an interface that assists the user through a setting/calibration sequence that may require one or more pusher/selector actuations for which the user may not otherwise know, understand, remember and/or be able to recall.

It is believed that the foregoing is best achieved by pointing to or rotating (e.g. "spinning," "wiggling," "waggling" and/or "oscillating") one or more indicator hands at a position so as to indicate which pusher/selector is next needed for actuation to effectuate a setting/calibration of the feature or function. In this way, the user need not be required to read, learn, know, understand, remember and/or recall actuation sequences, whether simple or complicated, and whether such sequences require one (1) or more actuations, and/or regardless of the order in which such actuations are needed to be effectuated, since the device will in effect prompt the user accordingly.

SUMMARY AND OBJECTIVES OF THE INVENTION

It is thus an objective of the present invention to overcome the perceived deficiencies in the prior art.

Specifically, it is an objective of the present invention to provide an improved user interface for setting and/or calibrating one or more features and/or functions in an electronic device of the analog type.

Moreover, it is an object of the present invention to provide an improved user interface that facilitates a user's ability to set and/or calibrate one or more features and functions in an electronic device, such as, but not limited to, an "analog type" timepiece (e.g. a watch).

It is a further object of the present invention to provide a timepiece that includes the improved user interface as disclosed herein.

Further objects and advantages of this invention will become more apparent from a consideration of the drawings and ensuing description.

The invention accordingly comprises the features of construction, combination of elements, arrangement of parts and sequence of steps which will be exemplified in the construction, illustration and description hereinafter set forth, and the scope of the invention will be indicated in the claims.

To overcome the perceived deficiencies in the prior art and to achieve the objects and advantages set forth above and below, the present invention is, generally speaking, directed to a method of setting/calibrating a feature or function in a setting/calibrating mode of an electronic device comprising at least one actuatable selector, wherein the setting/calibrating of the feature or function requires an actuation of the at least one selector, wherein the electronic device comprises at least one indicator hand coupled to an actuation mechanism that rotates the at least one indicator hand in at least one of a clockwise and counterclockwise direction, wherein the method comprises the steps of using the at least one indicator hand to indicate the actuatable selector for actuation; setting/calibrating the feature or function; and exiting the setting/calibration mode.

In accordance with another preferred embodiment, the present invention is directed to an electronic device comprising at least one actuatable selector, wherein a setting/calibrating of a feature or function in the electronic device requires an actuation of the at least one selector, wherein the electronic device comprises at least one indicator hand coupled to an actuation mechanism that rotates the at least one indicator hand in at least one of a clockwise and counterclockwise direction; and a controller operatively coupled to the actuation mechanism and the at least one actuatable selector for causing the at least one indicator hand to rotate in at least one of a clockwise and counterclockwise direction, and wherein the controller carries out the setting/calibrating of the feature or function step as disclosed herein.

In a preferred embodiment, the electronic device is a wristworn timepiece.

BRIEF DESCRIPTION OF THE DRAWINGS

For a fuller understanding of the invention, reference is had to the following description taken in connection with the accompanying figures, in which:

FIGS. 1A-1I are views of an "analog type" timepiece constructed in accordance with a preferred embodiment of the present invention, illustrating a sequence of steps to carry out a setting/calibration of a feature or function in accordance with a preferred embodiment of the present invention;

Identical reference numerals in the figures are intended to indicate like parts, although not every feature in every figure may be called out with a reference numeral.

DETAILED DESCRIPTION OF THE PREFERRED EMBODIMENTS

The present invention is directed to a method of setting and/or calibrating a feature and/or function in an "analog type" electronic device, which in the preferred embodiment, is a wristwatch. "Analog type" for purposes of this patent application is intended to mean using one or more indicator hands that are rotated using an actuation mechanism, such as a stepper motor.

However, it should be understood that the present invention need not be a wristwatch, as other devices are very much contemplated hereby, and thus covered by the present claims. Reference could therefore also be made to U.S. Pat. No. 7,113,450 for such examples.

For example, U.S. Pat. No. 7,113,450 discloses a wide variety of devices and applications to which the present invention is applicable. That is, while the following embodiments herein will be disclosed in connection with the setting and/or calibrating of a compass feature or function in a timepiece, the scope of the invention is not so limiting. For example, the feature or function to be set or calibrated may relate to speed and distance measurements, or heartrate and/or blood pressure measurements, astronomical data, sun/moon phases, the tide, altimeter readings and/or time related measurements, just to name a few, the important feature being that it incorporates the functionality as will be disclosed herein.

Reference will be made momentarily to FIGS. 1A-1I, which illustrate an electronic device, generally indicated at 10, constructed in accordance with the present invention and which preferably may include other functionality, such as time-keeping functionality, thereby making device 10 preferably a timepiece (e.g. watch). Although some non-essential details of FIGS. 1A-1I will be omitted for purposes of brevity, the reader is invited to read U.S. Pat. Nos. 7,113,450 and 6,975,562, the disclosures of which are incorporated by reference as if fully set forth herein. Both the '450 patent and the '562 patent provide additional detailed descriptions of how a controller, as set forth by reference number 100 therein, can individually control and operate each of the indicator hands. As disclosed below, controller 100 and the functionality thereof, among other disclosure in the '450 and '562 patents, are incorporated herein by reference to provide the controller functionality needed herein.

The present disclosure also omits, for purposes of brevity, certain basic and very well-known concepts regarding the construction of an analog timepiece. For example, the basic construction and arrangements of gears and/or gear trains to rotate a plurality of "standard" hands all supported on a center stem, such as an hour hand, a minute hand and a "seconds" hand, will be omitted as being well within the purview of one skilled in the art. Likewise, the selected movement of yet additional display hands, such as indicator hand 20 is also disclosed in the aforementioned '450 patent as well as below to ensure full disclosure thereof.

Figure 2:
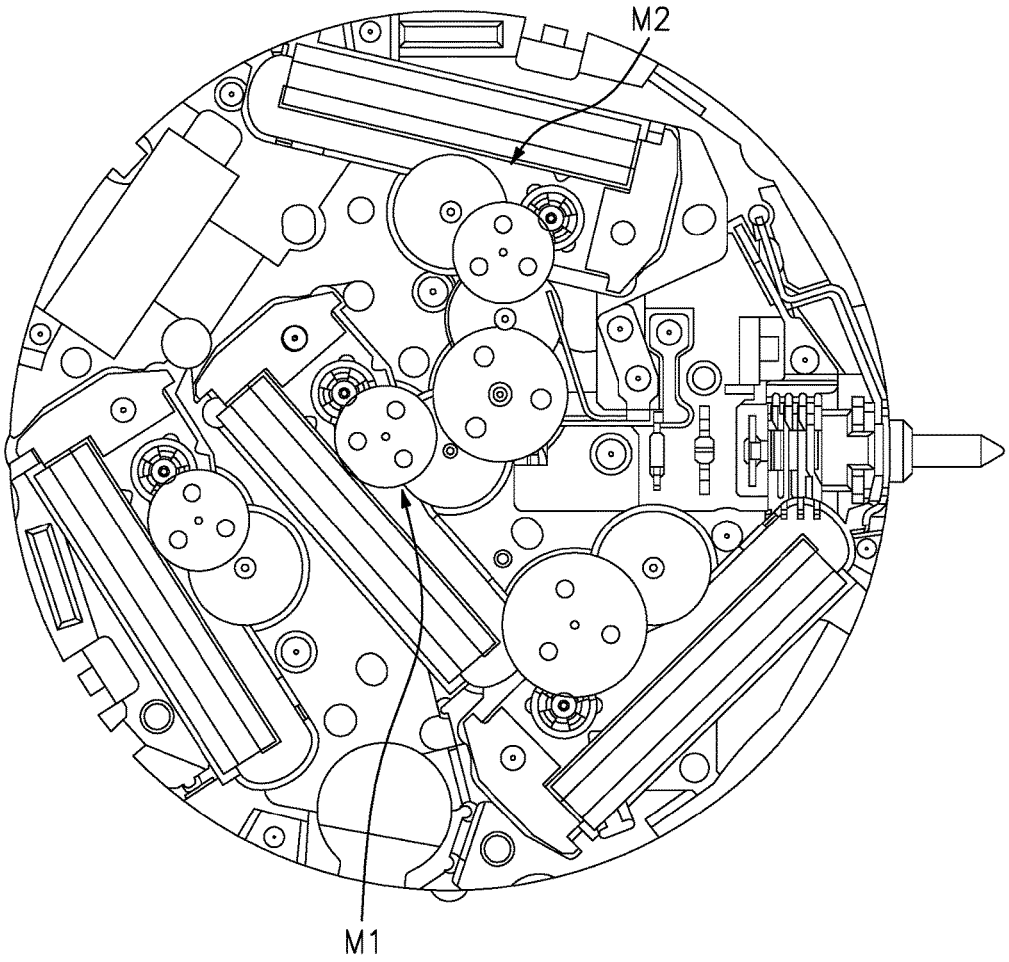
FIG. 2 illustrates the underside of the electronic device illustrated in FIGS. 1A-1I.

Reference is thus first briefly made to FIG. 2, which illustrates four stepper motors, the two of most relevance to the present invention being generally indicated by M1 and M2. One skilled in the art would recognize that varying the number of indicator hands can vary the number of needed stepper motors. As positioned in the module of the present invention, motor M1 is provided to rotate hour hand 12, minute hand 14 and second hand 16 all in a known manner. Specifically, hour hand 12, minute hand 14 and second hand 16 are coupled to a gear train for conveying the rotational activity generated by the rotor of motor M1. In a similar manner, indicator hand 20 is rotated by stepper motor M2, and a gear train is provided to convey the rotational activity generated by the rotor of motor M2 to hand 20. As would be understood, other indicator hands could be used in connection with the present invention, and the other motors disclosed herein could be used to effectuate such rotation. U.S. Pat. No. 7,258,481, the subject matter of which is also incorporated herein by reference, may be consulted therefor. The constructions of appropriate gear trains are well within the purview of one ordinarily skilled in the art.

Preferably, the motors applicable for the present invention, e.g. at least motor M2, is a bi-directional stepper motor, although in a specific embodiment, motor M1 may also be bidirectional if it is also to be used to carry out aspects and functionality of the present invention. That is, as provided for in the claims and discussed herein, if second hand 16 were to be used as an alternative indicator hand, then motor M1 would also preferably be a bi-directional stepper motor. Even further advantageous if needed or desired, any/all of the other hands (e.g. the hour hand and/or the minute hand) could be, and perform the functionality of, the one or more indicator hands if desired. As such, the hour hand and/or the minute hand could also be provided with their own respective independent motors, while still providing accurate time-telling and/or other information as would be understood in the art. In other words, the present invention is not limited to any specific number of motors and/or hands that could provide the functionality of the disclosed indicator hands as desired by the skilled artisan. The construction of acceptable stepper motors to functionally operate in this manner are widely commercially available and well within the understanding of those skilled in the art. It should also be understood that it is well within the skill of the designer to design an appropriate gearing ratio to provide for the desirable rotation speed and step increment size of at least indicator hand 20, if not also second hand 16 if acting as a second indicator hand.

Pushers S1, S2 and S3 are essentially switches as would be understood in the art, and may also be individually referred to herein as a "selector." Selectors S1, S2 and S3 are intended to generically indicate both side and top mounted pushers and C1 indicates the setting stem/crown, which may also be deemed to be a "selector" as disclosed and claimed herein. Selectors S1, S2 and S3 are intended to be actuated by pushing while setting stem/crown C1 can be actuated by axially displacement and/or rotation in a clockwise and/or counterclockwise direction, as set forth in U.S. Pat. No. 6,896,403 the subject matter of which is also incorporated by reference as if fully set forth herein. Collectively and individually, selectors S1, S2 and S3 and setting stem/crown C1 may also be deemed the "setting/calibration" mechanism of the present invention.

Turning now to the particulars of the present invention, a preferred method may begin with electronic device 10 entering the setting/calibration mode. The term "setting/calibration" (and all forms of the words (e.g. "set/calibrate")) is intended to broadly cover any setting and/or calibrating operation of a feature or function of an "analog type" electronic device. For example, in the context of a compass setting/calibration, it is possible to set/calibrate the declination angle. Similarly, in the context of a countdown timer/stopwatch feature, setting or calibrating the timer/stopwatch hands (i.e. to either initialize or set them accordingly) would be deemed to be "setting/calibrating" the feature or function of the timer or stopwatch hands. Similarly, resetting the position of one or more hands (e.g. of a chronograph watch) would also be "setting/calibrating" the feature or function of the hands of a chronograph watch. Therefore, and generally speaking, the setting or calibrating of a feature of a watch (e.g. hands, positions thereof, etc.) or a function of the watch (e.g. a compass calibration) should be deemed to be within the definition of "setting/calibrating" a feature or function as claimed herein. Moreover, the use of "feature or function" in the claims is not intended to be limiting. That is, the claims are written to be interpreted as being able to set and/or calibrate a feature and/or function, and that the invention is not limited to one or the other. Therefore, claims are interpreted as being infringed by a device or method that sets a feature, sets a function, calibrates a feature and/or calibrates a function. In other words, the use of "or" is not intended to exclude the other.

When operating in the setting/calibration mode, the indicator hand(s), e.g. hand 20, are advantageously used to indicate to the user which selector is the next "selector" for selecting in the setting/calibration mode. Such indication may be achieved by rotating the rotor of the respective stepper motor an appropriate number of pulses in the forward and/or reverse direction at the desired frequency to position the hand in front of the desired selector. As discussed herein, the controller (i.e. controller 100) maintains information on the rotor position so that proper rotation of the rotor can be effectuated and the indicator hand(s) can be accurately positioned.

Accordingly, the preferred methodology includes the initiation of an actuation sequence, which in the preferred embodiment, is achieved by the actuation of the setting/calibration mechanism, which can be achieved by a pull of the crown into a second of at least two axial positions. With electronic device 10 now in the setting/calibration mode, at least a first indicator hand 20 will begin to rotate in a clockwise and/or a counterclockwise direction. The rotation will also preferably be in a manner independent of the actuation sequence, as will be defined below.

By the phrase "rotate in a clockwise and/or a counterclockwise direction" or the more accepted claim language "in at least one of a clockwise and counterclockwise direction" it is intended to mean that the particular indicator hand may do one of two things, namely it may toggle back and forth (e.g. "waggle", "wiggle" or "oscillate") or it may spin, e.g. 360°, and may do so both/either in a clockwise and/or a counterclockwise direction (all generically referred to as "rotate") if a bi-directional stepper motor is used. A "wiggling", "waggling" or "oscillating" ability of the hand is disclosed in the aforementioned U.S. Pat. No. 7,258,481. The purpose of using such language is to appreciate the ability for any of the indicator hands, e.g. hand 20, to both spin and "waggle." On the other hand, if only a unidirectional stepping motor is used, the indicator hand may spin or otherwise simply rotate in only one direction.

Figure 1A:
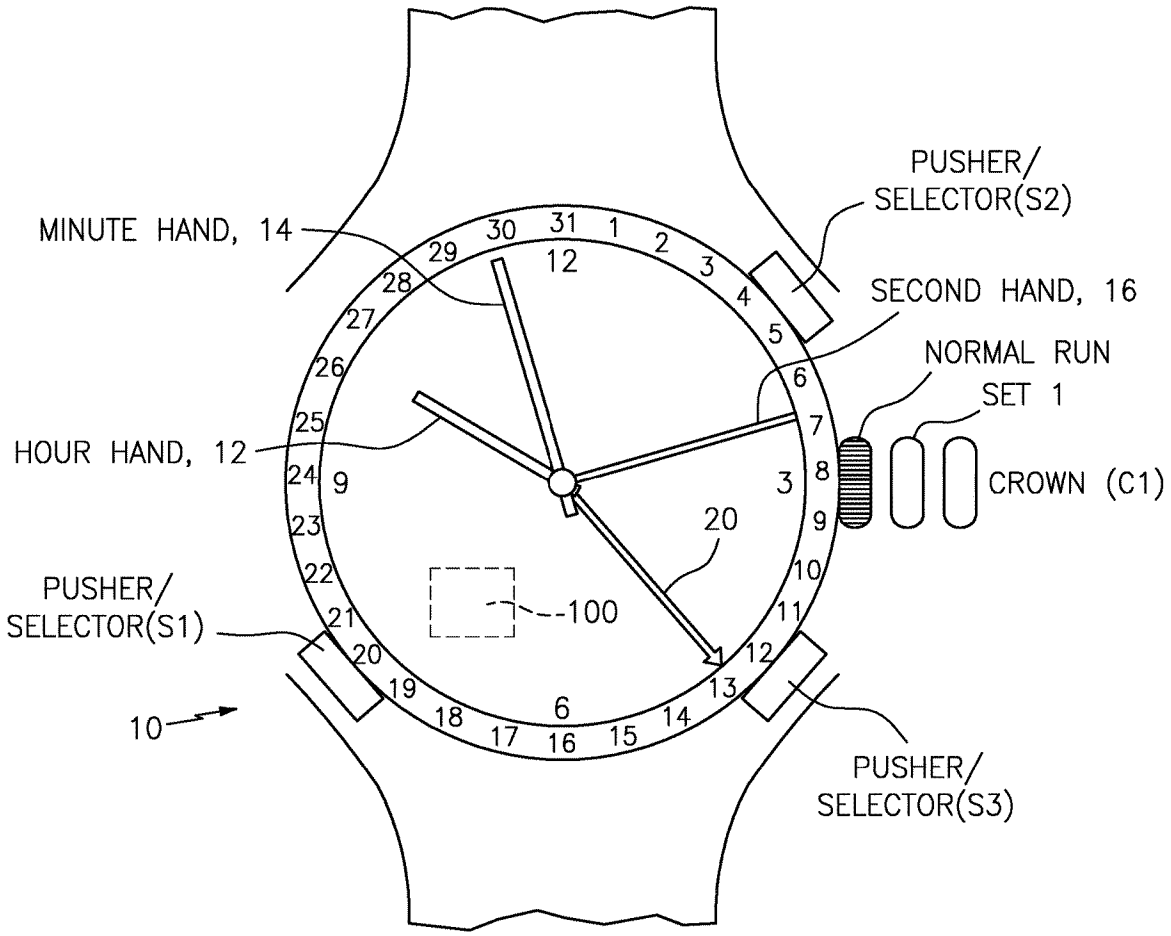
Figure 1B:
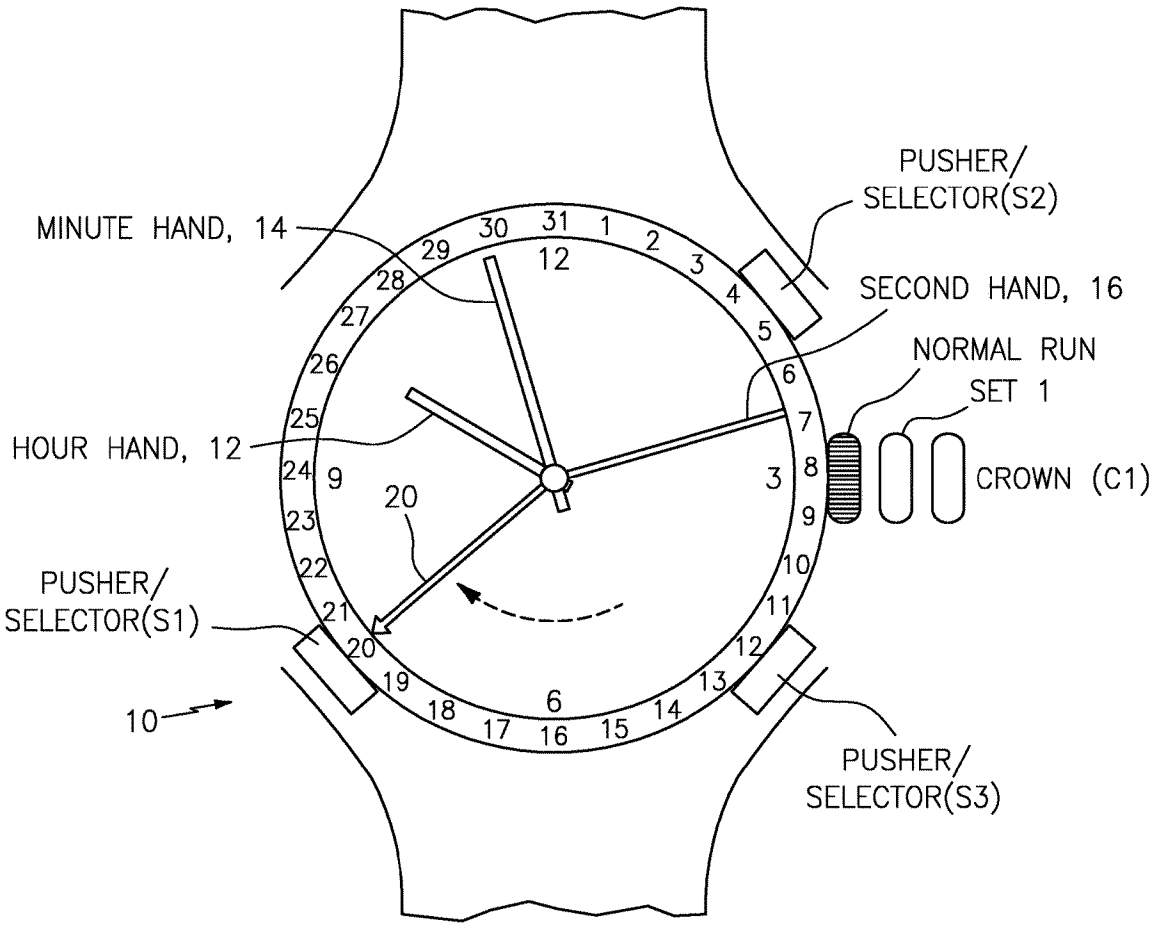

FIG. 1A, illustrates an early step in accordance with a preferred embodiment, wherein the electronic device 10 has been placed into the setting/calibrating mode for the compass mode, for example, which could be achieved for example, by pulling crown C1 out one position to a SET1 position. As but other examples, electronic device 10 could be placed into the setting/calibrating mode for a countdown timer/stopwatch feature for setting or calibrating the timer/stopwatch hands by pulling crown C1 out two (2) positions to a SET2 position. As yet another example, the electronic device 10 could be placed into the setting/calibrating mode for a resetting of the position of one or more hands (e.g. of a chronograph watch) by pulling crown C1 out three (3) positions to a SET3 position.

Figure 1C:
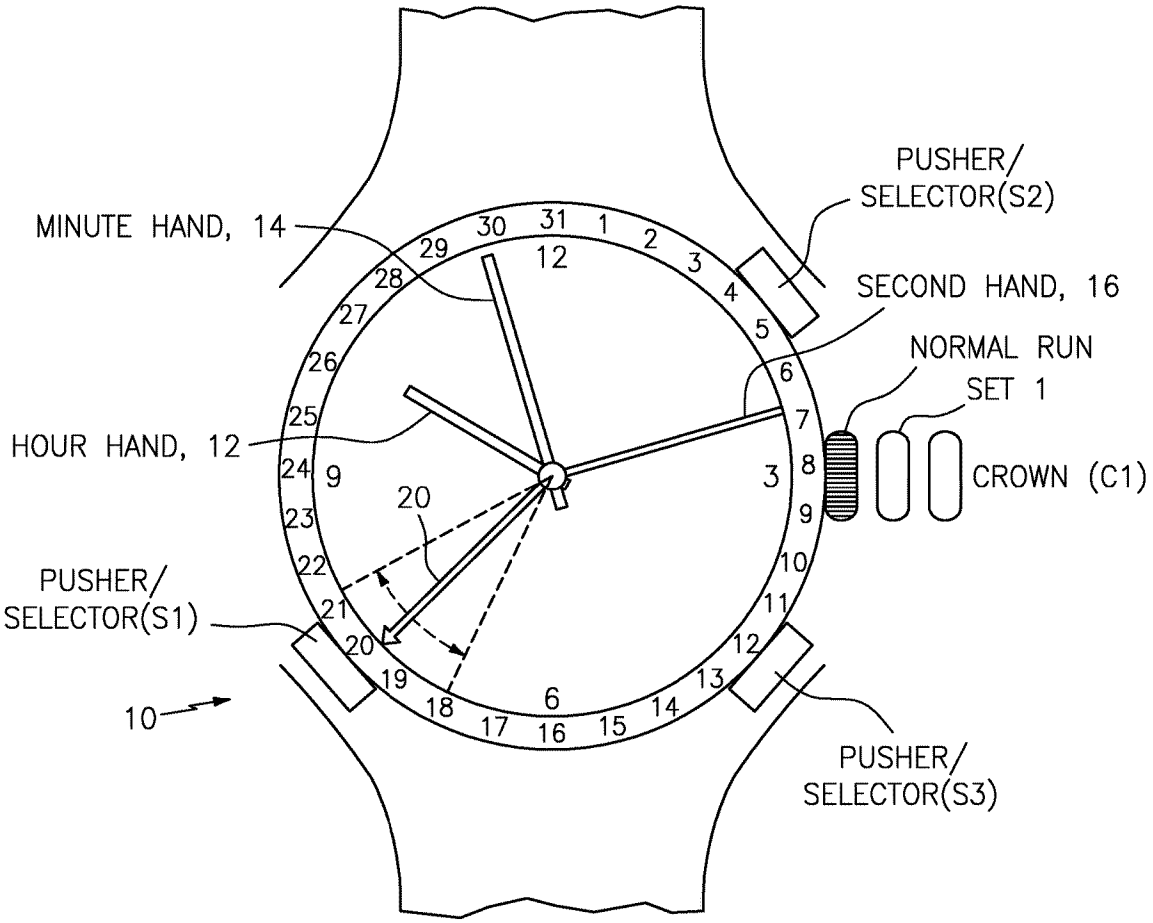

Once in the setting/calibration mode, indicator hand 20 rotates either CCW or CW until it is pointing to selector S1. In the illustrated exemplary embodiment, indicator hand 20 has rotated in the CW direction. Indicator hand 20 will simply stop at, and point to, selector S1. In an alternative embodiment, indicator hand 20 may indicate the selector for actuation by rotating in both a clockwise and counterclockwise direction proximate the selector for actuation. Specifically, indicator hand 20 may "wiggle" in front of selector S1 as illustrated in FIG. 1C. By "proximate," it is intended to mean within a distance to the right, center and/or left of the selected selector such that one skilled in the art would know that it is in fact the particular selector selected from the remaining selectors available for selecting. Either way, by pointing to selector S1 or the "wiggling" in front of or proximate selector S1, the electronic timepiece makes it known to the user that the desired setting/calibration sequence of selector actuations in the sequence requires the actuation of selector S1.

In the exemplary embodiment, actuation (e.g. by pushing) of selector S1 causes the electronic device to begin the setting/calibration sequence.

Figure 1D:
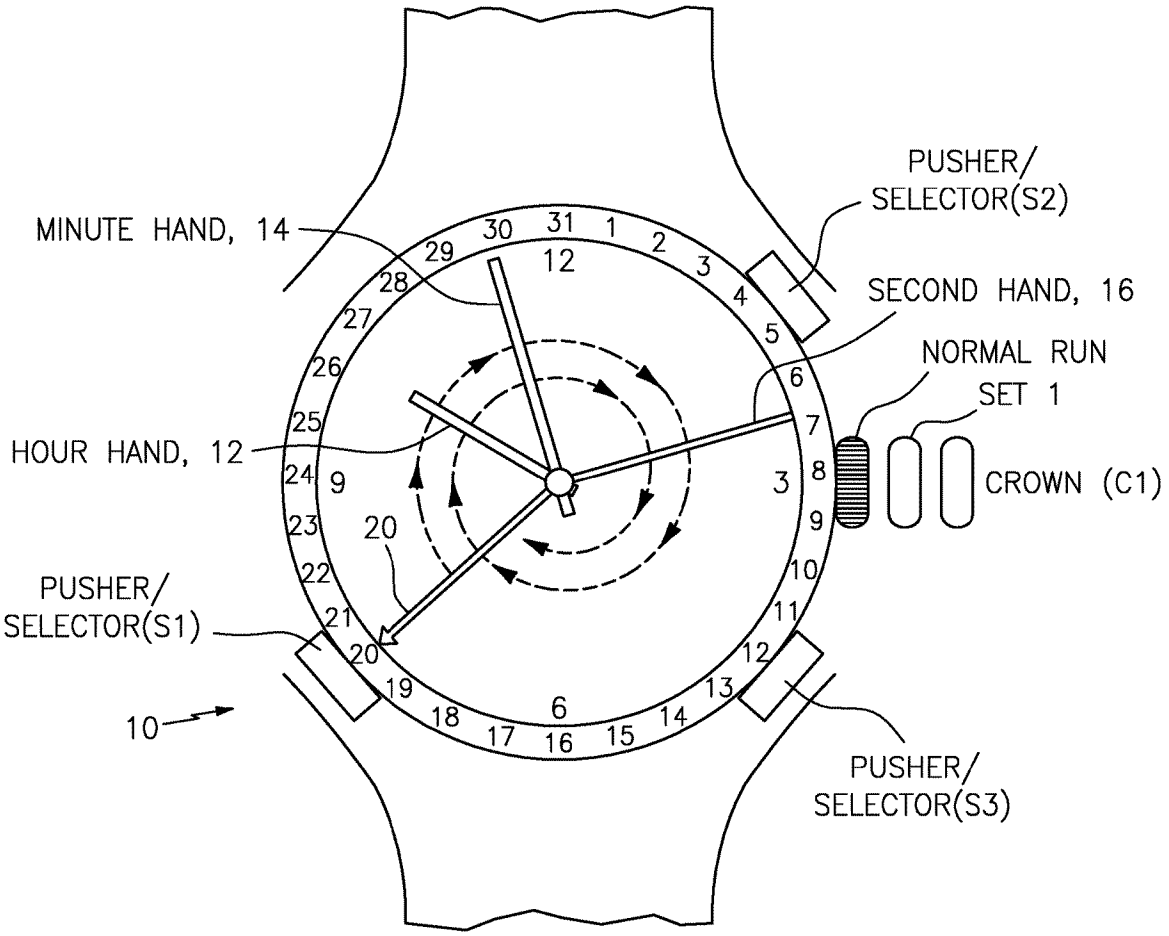
Figure 1E:
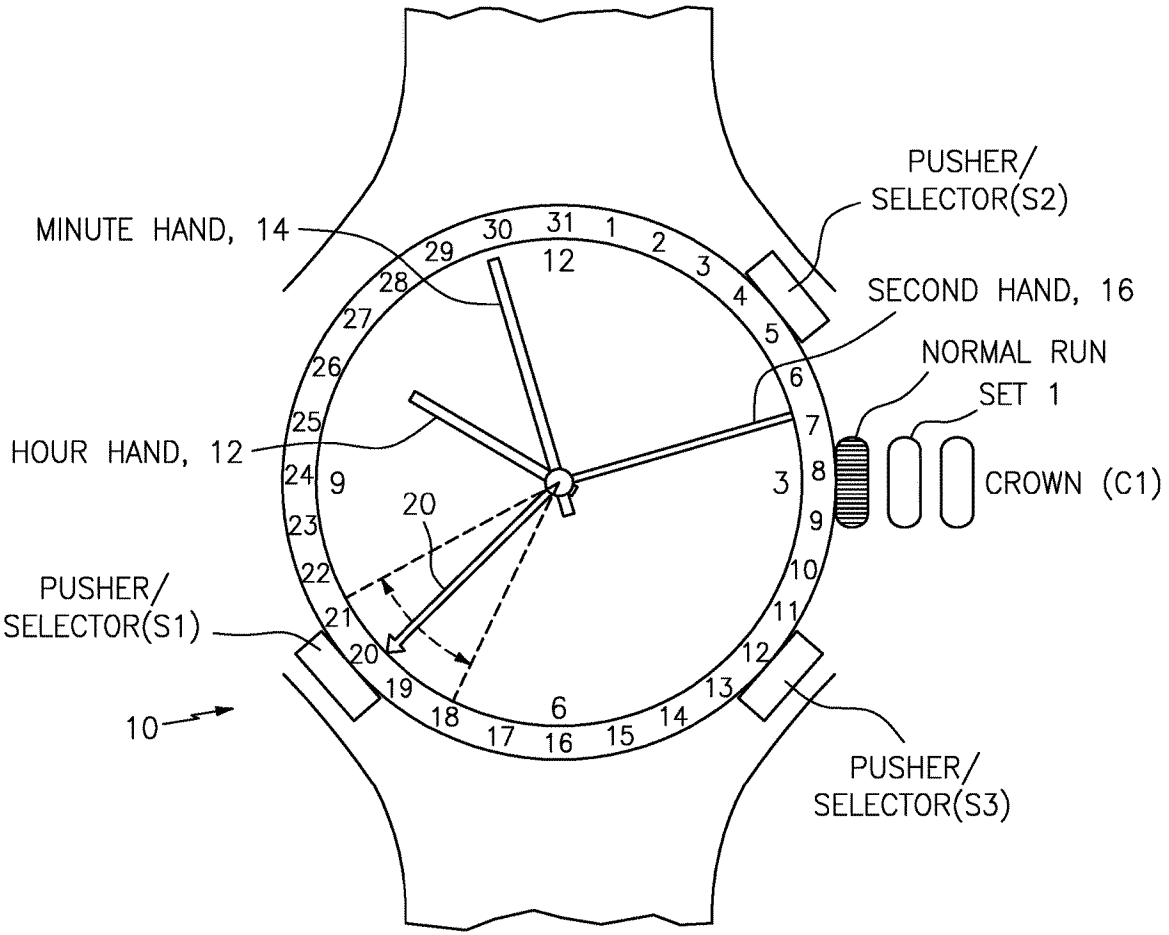

Specific to a setting/calibration feature in a compass mode for example, the user may need to rotate device 10 to provide for proper calibration. For example, it may be needed to rotate device 10 about its center around two (2) times. To convey this to the user, indicator hand 20 may itself rotate 360° two (2) times. FIG. 1D illustrates indicator hand having rotated two (2) times.

The rotational speed of indicator hand 20 can be set depending on motor constraints or desired design characteristics as would be understood in the art. Alternatively, the rotational speed of indicator hand 20 could be designed to correspond to the desired speed with which the user is to rotate the device about its center for calibration, i.e. in the exemplary compass mode. In an exemplary embodiment, a complete revolution of indictor hand 20 may take 15 seconds, thereby corresponding to the rate at which the user is expected to (or should) be rotating the device around.

Next, in the exemplary sequence, the user is expected to press selector S1 to continue the compass calibration. This is exemplified in FIG. 1E where indicator hand 20 is again pointing at selector S1. Here again, indicator hand 20 may simply point to selector S1, or in an alternative embodiment, indicator hand 20 may indicate selector S1 by "wiggling" in front of selector S1 as was illustrated in FIG. 1C. In this latter way, the device 10 makes clear that user action is needed to actuate selector S1.

The user may thus proceed to actuate selector S1 by the pressing thereof. In the exemplary embodiment, by actuating selector S1, indicator hand 20 will move to the current magnetic declination setting to show the current angle value.

At this point, the user could simply proceed to confirm the compass calibration without setting the declination angle. This could be done by having the user simply know that pressing crown C1 back to its normal RUN position will conclude the setting/calibration sequence. Alternatively, and taking advantage of the present invention, indicator hand 20 could divert from the calibration sequence and momentarily, for example, rotate to point to or "wiggle" proximate crown C1 to indicate to the user the option of pressing crown C1 back to the normal RUN position.

Figure 1F:
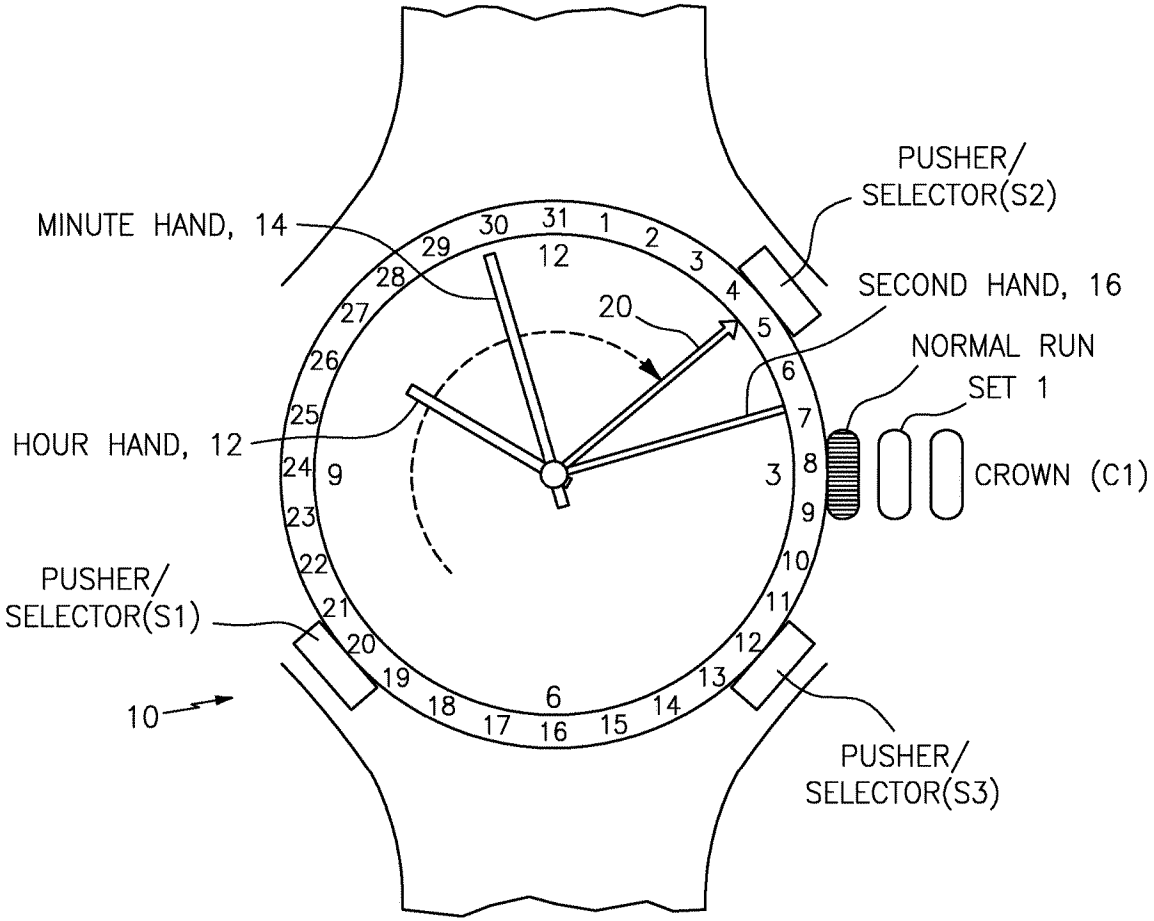

Alternatively, the preferred method could simply wait a predetermined amount of time, and if there has been no actuation of crown C1 back to the RUN position, indicator hand 20 would then rotate (either CCW or CW) so as to point to selector S2, as illustrated in FIG. 1F. Again, and in an alternative embodiment, indicator hand 20 may indicate selector S2 for actuation by "wiggling" in front of selector S2 in a similar "wiggle" motion as was illustrated in FIG. 1C. Either by pointing to selector S2 or the "wiggling" in front of or proximate selector S2, timepiece 10 makes it known to the user that the desired setting/calibration sequence requires the actuation of selector S2 if the user wants to set the declination angle.

Figure 1G:
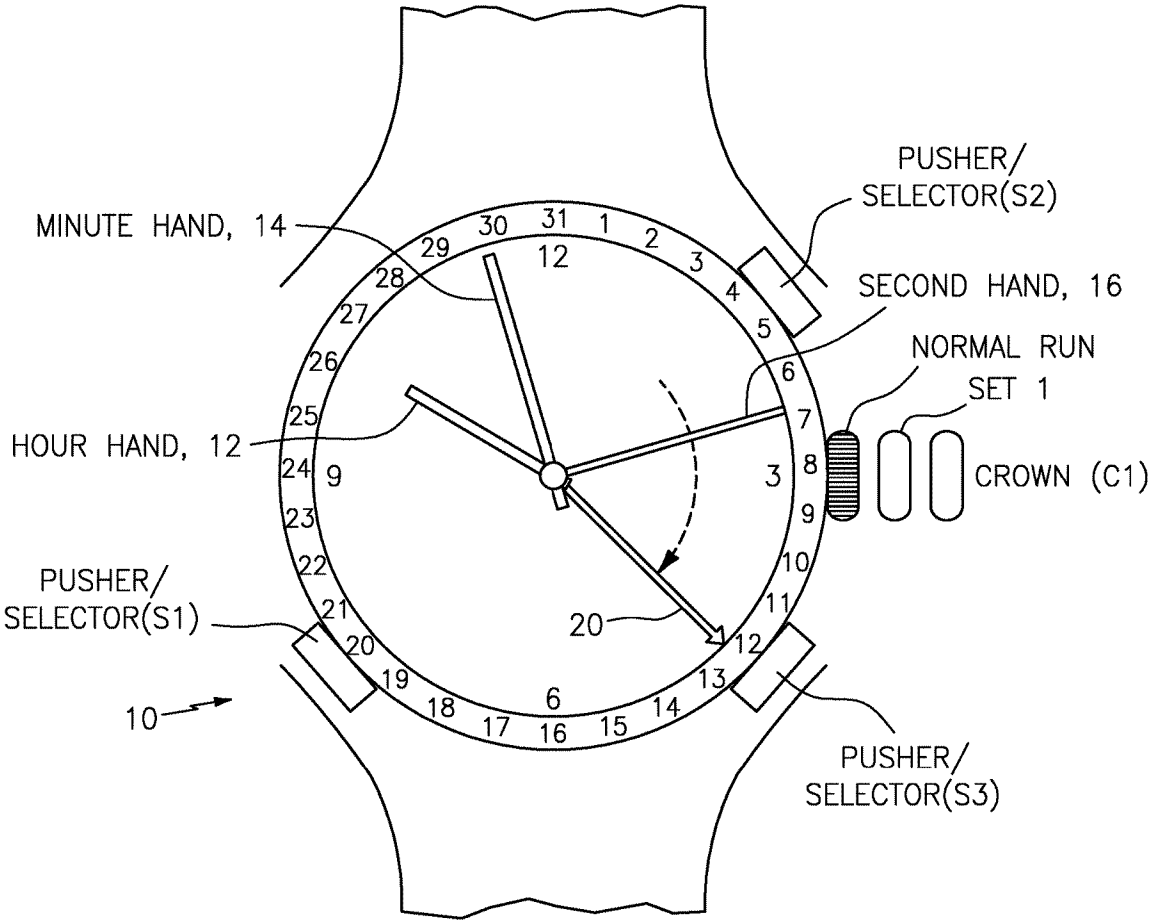
Figure 1H:
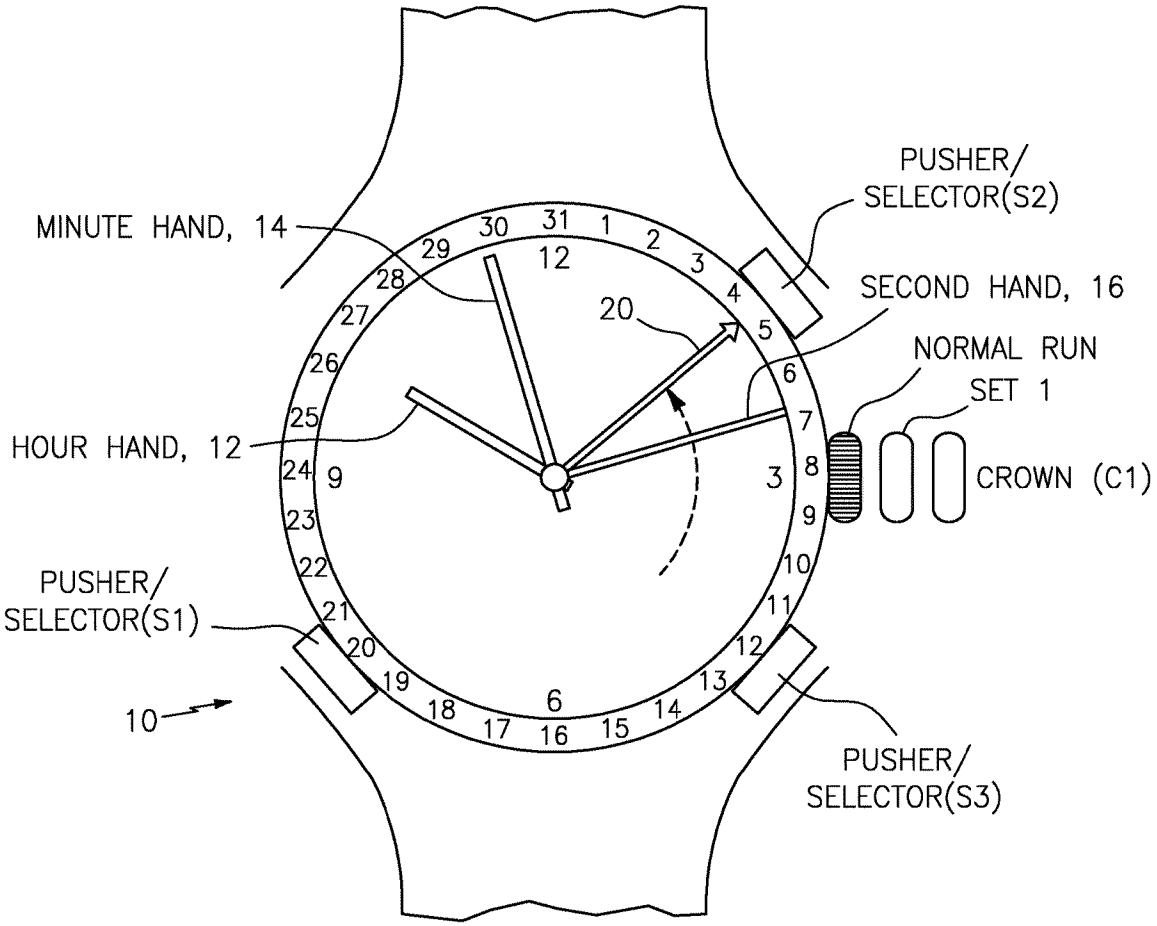
Figure 11:
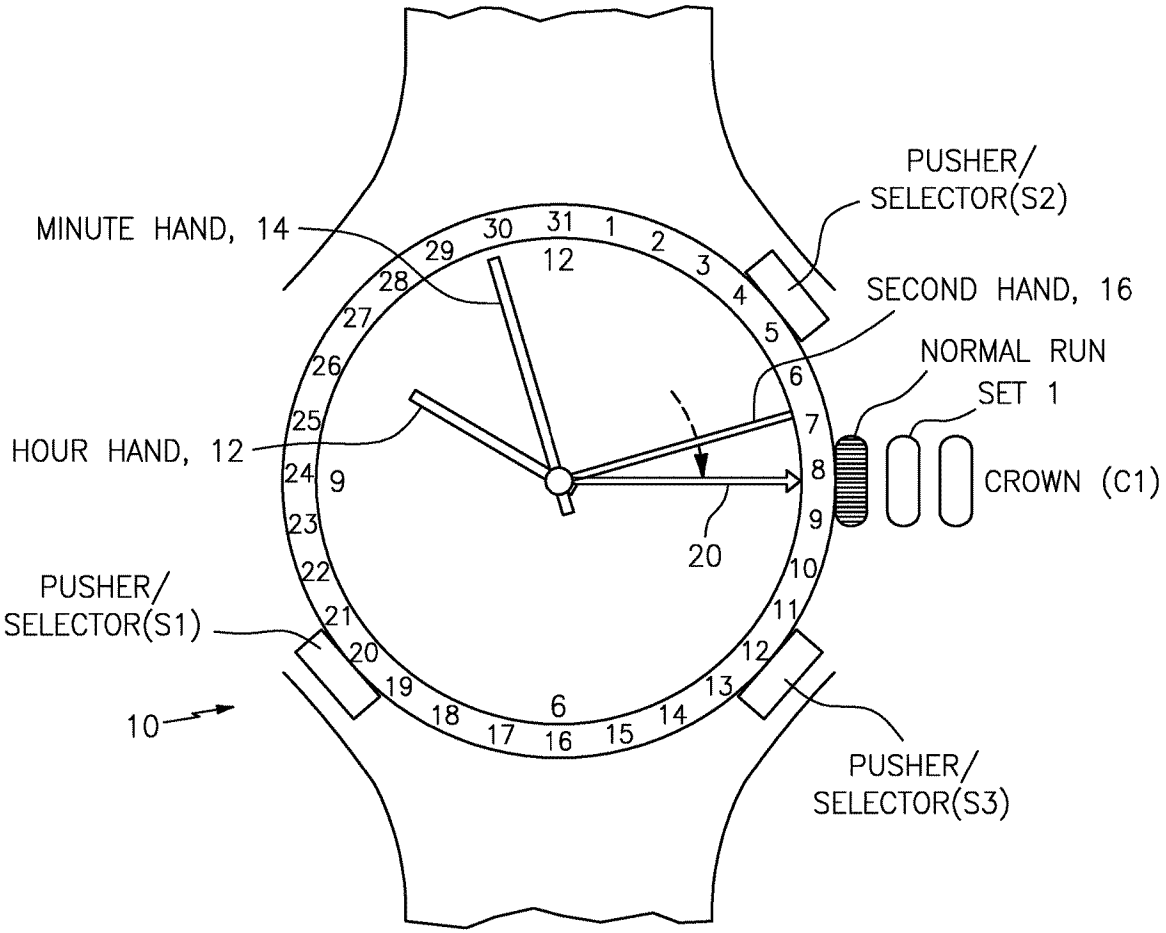

If the declination angle is not set by actuating selector S2, the indicator hand 20 could/would then rotate to selector S3 as illustrated in FIG. 1G. Again, to indicate to the user that selector S3 could be actuated to set the declination angle, indicator hand 20 could simply point to selector S3 or "wiggle" in front of selector S3 as discussed above.

As would thus be understood in the art, such movement of the indicator hand 20 conveys to the user which selectors are to be actuated to set the declination angle, as selecting either selector S2 or S3 activates the declination angle setting. Moreover, by repeated actuation of the selectors 82 (e.g. +) and 83 (e.g. −) the user can adjust the declination angle.

With knowledge of the setting/calibration sequence, the user could then simply press crown C1 back to its normal RUN position, which will conclude the setting/calibration sequence. Alternatively, and again taking advantage of the present invention, indicator hand 20 could momentarily rotate to point to crown C1 to indicate to the user the option of pressing crown C1 back to the normal RUN position.

Reference has been made herein to the indicator hand rotating "in a manner that is independent of the actuation sequence." This is intended to distinguish the inventive feature from prior art devices that provide for hand movement in stepped increments in direct response to specific actuations of a pusher or the turning of a crown for example. That is, in the prior art, a single button press may cause the hand to move one unit, two successive button presses may cause the indicator hand to move two units, or continued actuation may cause the hand to spin, etc. In distinction, the present language is intended to imply, for example, that a simple actuation of the setting/calibration mechanism (e.g. a single button push or a "pull" of the setting stem) may cause the indicator hand to "wiggle/waggle" back and forth one or more times, or may cause the hand to rotate, e.g. 360° around one or more times.

In a preferred methodology, there may be a timed delay (e.g. 3 or 5 seconds) from the initial actuation of the setting/calibration mechanism (i.e. to place electronic device 10 in the setting/calibration mode) to the actual commencement of movement of hand 20 in the clockwise or counterclockwise direction. If the user wishes to actuate the appropriate selector, the user need only commence the actuation thereof within a predetermined period of time.

The foregoing sequence of steps can be expanded to include any number of indicator hands or the positioning thereof. That is, in an exemplary embodiment, the setting/calibration of the feature or function may require more than one (1) selector actuations. The present invention thus contemplates the utilization of at least a second indicator hand, e.g. hand 16, which itself is coupled to stepper motor M1 that rotates hand 16 in at least one of a clockwise and counterclockwise direction. A preferred method may include the steps of (a) using the second indicator hand 16 to indicate a next selector (e.g. selector S2 and/or S3) for actuation; (b) indicating a next selector for actuation with either the first indicator hand 20 or second indicator hand 16 to effectuate the setting/calibration of the feature or function; and returning to step (b) to continue to indicate a next selector for actuation until the sequence is completed. For example, if the setting/calibration sequence requires two (2) selector actuations, then an embodiment may require the use of a first indicator hand, e.g. 20 or 16, to indicate a first selector for actuation and then use a different indicator hand, e.g. the other of hand 20 or 16 to indicate the second/next selector for actuation.

In the above compass calibration example, hand 20 may be used for the first indication of selector S1 and hand 16 could be used for the selection of selector S2 and then either hand 20 or hand 16 may be used thereafter for pointing to selector S3. Of course, if hand 16 is used for any of the pointing, etc., the controller 100 maintains its position to be able to return the time-telling hands (e.g. hand 16 and hour and minute hands 12, 14) to their accurate positions.

If the setting/calibration sequence requires three (3) or more selector actuations, then a particular embodiment would provide for the sequence to proceed with continued indications of next selectors with either the first or second indicator hands until the sequence is completed. The claims herein recite an exemplary embodiment requiring at least N selector actuations, wherein $N \geq 2$. Thus, in the simplest of embodiments requiring only two (2) actuation sequences, a sequence might use first indicator hand 20 to indicate a first selector for actuation and then indicate a next selector for actuation with either the indicator hand 20 or indicator hand 16 to effectuate the setting/calibration of the feature or function. Since the sequence would be completed with these two actuations, the sequence would be completed. However, if N is greater than two (2) (e.g. $N=3$), then a return to select the third and final selector would be needed. Thus, there is a return to the foregoing step $(N-2)$ times. In the preferred embodiment, N is less than 10.

Thus, it should therefore be understood generally that the present invention is directed to a method of setting/calibrating a feature or function in a setting/calibrating mode of an electronic device comprising at least one actuatable selector, wherein the setting/calibrating of the feature or function requires an actuation of the at least one selector, wherein the electronic device comprises at least one indicator hand coupled to an actuation mechanism that rotates the at least one indicator hand in at least one of a clockwise and counterclockwise direction, wherein the method comprises the steps of using the at least one indicator hand to indicate the actuatable selector for actuation; setting/calibrating the feature or function; and exiting the setting/calibration mode.

In a preferred embodiment, the at least one indicator hand indicates the actuatable selector for actuation in a manner that is independent of an actuation sequence. In a specific embodiment, the at least one indicator hand points to the actuatable selector for selecting, but in an alternative embodiment, the at least one indicator hand indicates the actuatable selector for actuation by rotating in both a clockwise and counterclockwise direction (e.g. "wiggles" or "waggles") proximate the selector for actuation.

As discussed above, only using one indicator hand 20, the setting/calibration of the feature or function may require N selector actuations, wherein the method comprises the steps of (a) using the at least one indicator hand to indicate a next selector for actuation; (b) indicating a next selector for actuation with the at least one indicator hand to effectuate the setting/calibration of the feature or function; and (c) returning to step (b) (N−2) times, wherein N≥2. And, if more than one indicator hand is to be utilized and the setting/calibration of the feature or function requires N selector actuations (where N≥2), the method may comprise the steps of (a) using the at least second indicator hand to indicate a next selector for actuation; (b) indicating a next selector for actuation with the at least one indicator hand or second indicator hand to effectuate the setting/calibration of the feature or function; and returning to step (b) (N−3) times, when N is greater than three (3).

Although it should be clear as to the functionality of a controller for carrying out the present invention, for completeness, the following is set forth. Electronic device 10 may be provided with one or more subassemblies, each of which may comprise at least one actuation mechanism and one or more gears rotateably engaged with the actuation mechanism, wherein actuation of the actuation mechanism causes the rotation of the one or more gears which in turn rotate the indicator hands, e.g. hands 20 or 16. As illustrated in the figures, the preferred actuation mechanisms are stepper motors. FIG. 2 illustrates additional motors simply as a matter of design choice, and which may be used to rotate additional indicators, hands, rings or the like. As would also be understood in the art, the specific location of such motor(s) is one of design choice and dictated by constraints such as spacing, power and torque requirements and the desired positioning of the display hands and/or rings, as the case may be. As positioned, the respective motors rotate respective pinions as would be understood in the art.

Figure 3:
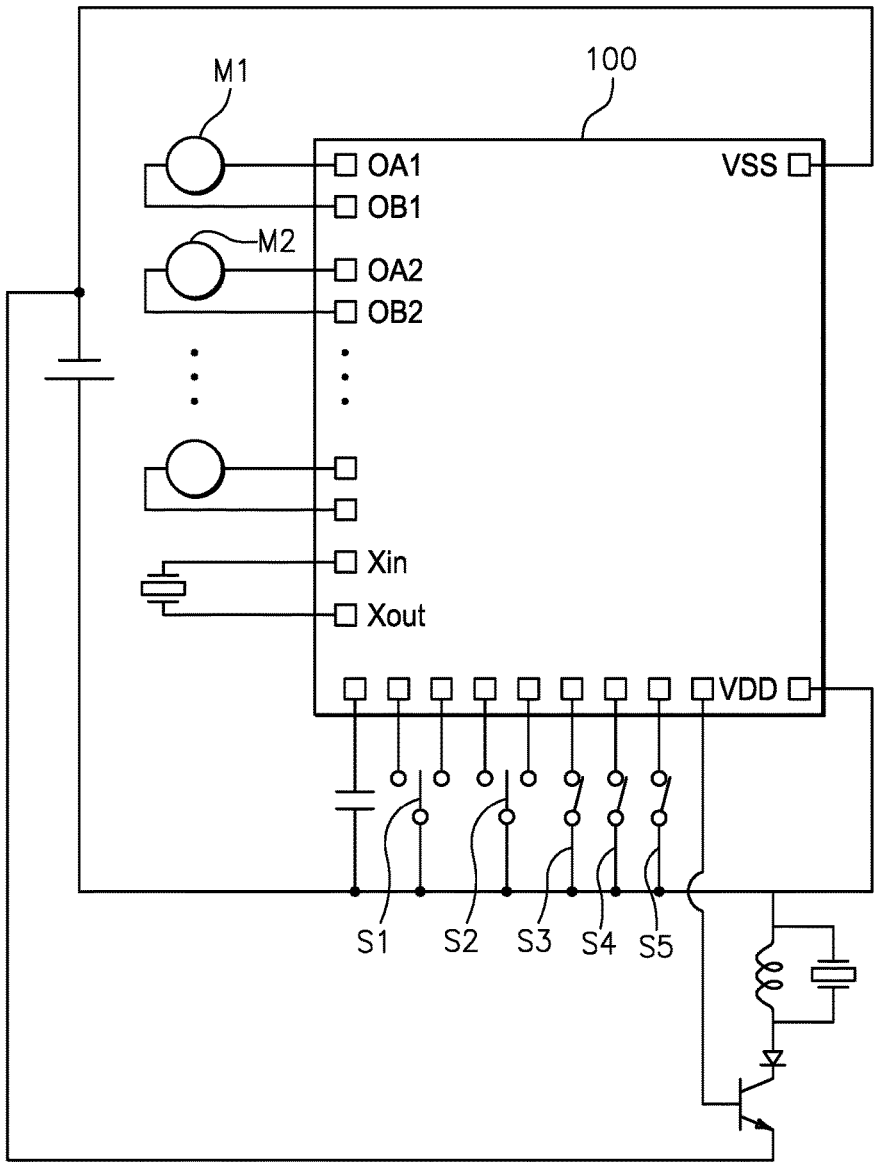
FIGS. 3-5 are block diagrams showing among other things, a controller for an electronic device constructed in accordance with all the preferred embodiments of the present invention.
Figure 4:
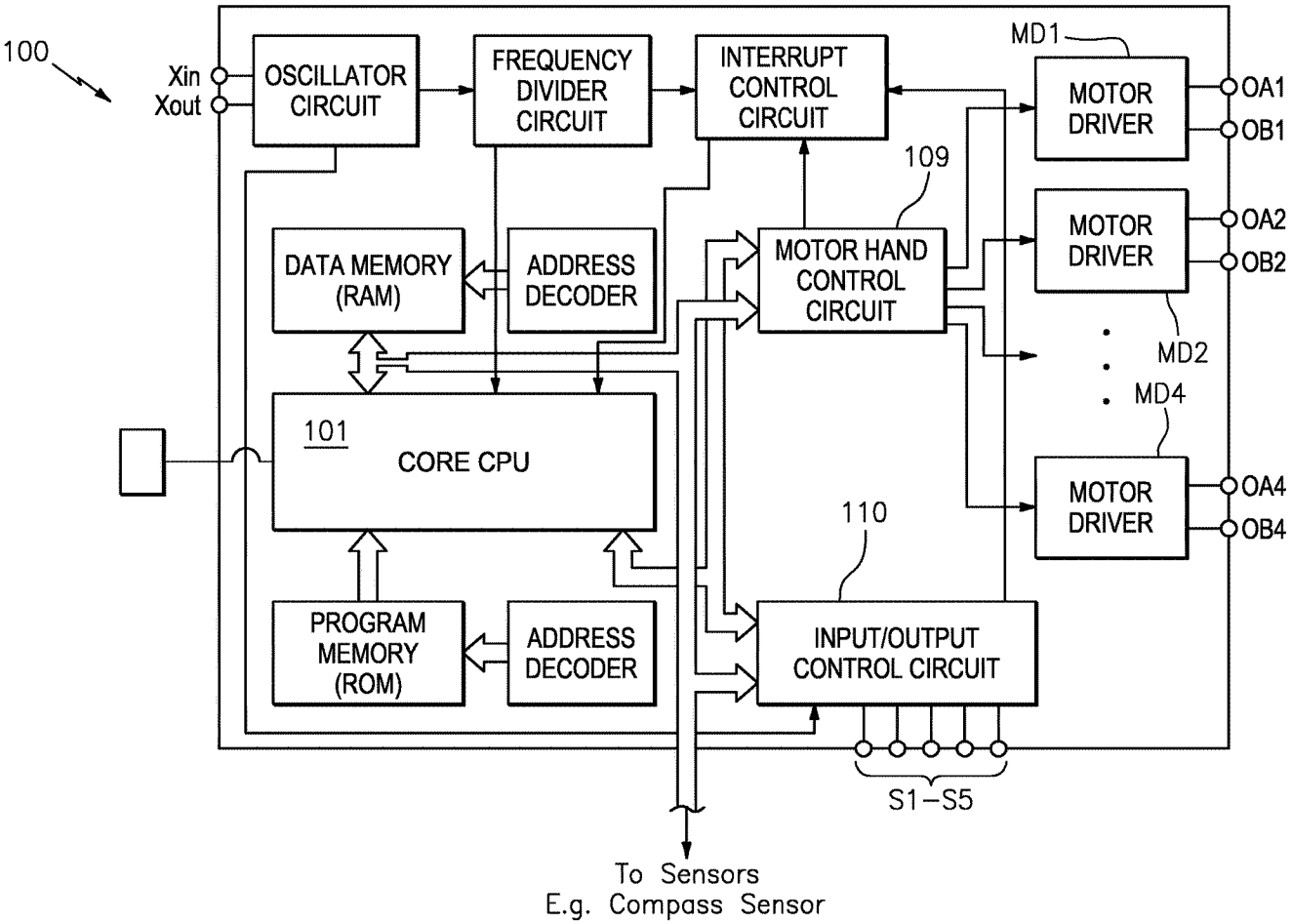
Figure 5:
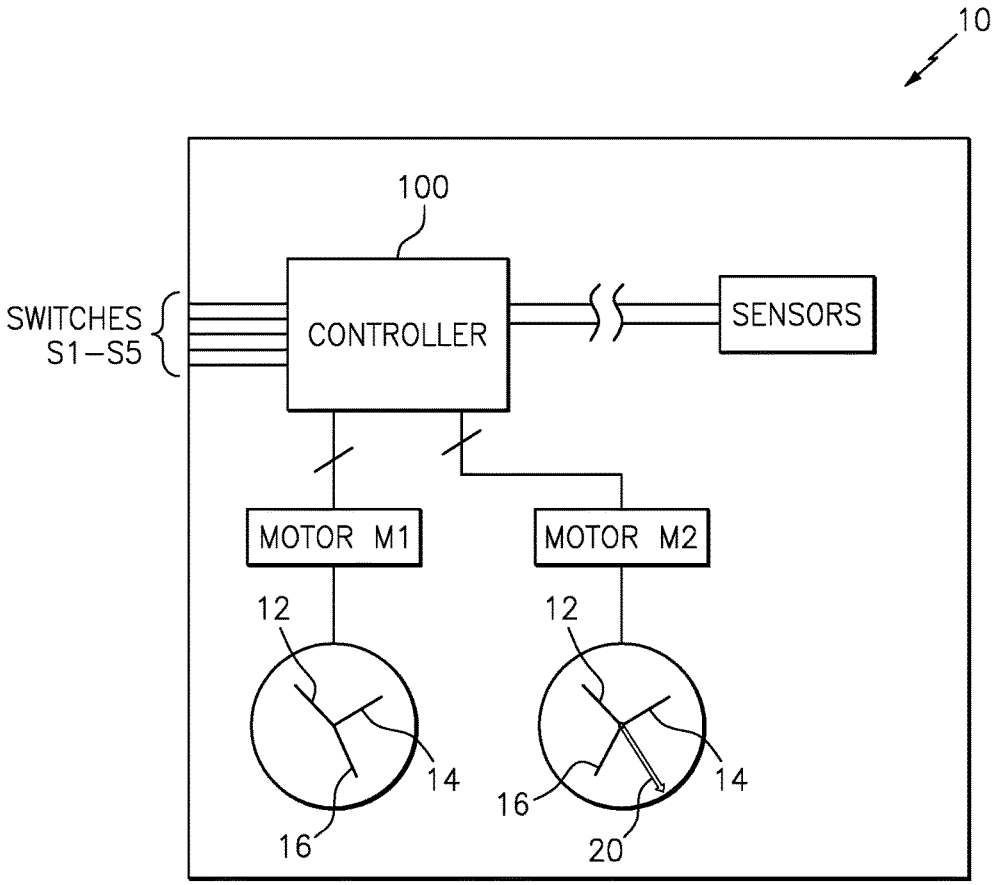

FIGS. 3-5 illustrate many additional features in accordance with the present invention, including details of controller 100 for providing the proper and accurate controlling, positioning and rotation of the one or more indicator hands. As also alluded to above, many details of controller 100 can be found in the aforementioned U.S. Pat. No. 7,113,450 by reference to controller 100, and the microcontroller 100 of the present invention preferably comprises all of the functional features described therein to carry out the objectives and features of the present invention.

For example, FIGS. 3-5 illustrate among other things, interface connections to motors M1 and M2 and pushers, which are illustrated schematically as selectors S1-S5. However, it is understood that the switches are also intended to generically indicate both side/top mounted pushers, as well as side mounted rotatable crowns, and thus respond to the actuation (i.e. pulling and/or pushing) action thereof.

FIGS. 4 and 5 illustrate block diagrams, including of controller 100. Particular reference is made to motor control circuit 109, which receives a commanded "next number of pulses" from CPU core 101 and generates the pulsed and phased signals necessary to move a desired motor (e.g. M2) a desired amount and in a desired direction. Pulse outputs of motor control circuit 109 are buffered by motor drivers MD1-MD4 and applied to the respective motors M1 and M2, as the case may be. An input/output control circuit 110 can controls any crown/stem actuations and/or pushbutton selectors S1-S5 and provides such signaling information to CPU 101.

As would be understood in the art and exemplary shown in the figures, motors M1 and M2 each comprise a rotor, and are operatively coupled to controller 100, wherein the stepper motor steps in at least one of a clockwise and counterclockwise direction in predefined increments in response to commands from the controller 100, wherein the rotor of the stepper motor is operatively coupled to the at least one indicator hand, and wherein the rotation of rotor causes the rotation of the at least one indicator hand in at least one of the clockwise and counterclockwise directions and in the predefined increments.

Device 10 also comprises the needed functionality, as the case may be, to perform the desired feature or function for which setting or calibration may be needed. For example, device 10 comprises the needed software and/or hardware to perform and provide the needed compass functionality, such as disclosed in U.S. Pat. No. 6,992,481, the subject matter of which is incorporated herein by reference as if fully set forth herein.

As can be seen above, while the present invention is particularly directed to the methodology as disclosed herein, the present invention is likewise directed to an improved electronic device, such as one that comprises at least one actuatable selector, wherein a setting/calibrating of a feature or function in the electronic device requires an actuation of the at least one selector, wherein the electronic device comprises at least one indicator hand coupled to an actuation mechanism that rotates the at least one indicator hand in at least one of a clockwise and counterclockwise direction; and a controller operatively coupled to the actuation mechanism and the at least one actuatable selector for causing the at least one indicator hand to rotate in at least one of a clockwise and counterclockwise direction, and wherein the controller carries out the setting/calibrating of the feature or function step as claimed in claim 1. Moreover, the electronic device of the present invention provides for the carrying out of the setting/calibrating of the feature or function step as claimed each and all of the claims herein, and Applicant reserves the right to expand and/or introduce additional claims accordingly.

Again, it should be clear that while the present invention is illustrated with respect to a compass mode setting/calibration feature, this is by way of example and not limitation as the present invention is applicable to a wide variety of applications. For example, and not limitation, pulling the crown to other positions may place device 10 in other setting/calibration modes.

Accordingly, it will be seen that the present invention provides the ability to guide a user through and to facilitate the setting/calibrations of a feature or function in an analog type electronic device.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It should also be understood that the following claims are intended to cover all of the generic and specific features of the invention described herein and all statements of the scope of the invention that as a matter of language might fall there between

What is claimed is:

1. A method of setting/calibrating a feature or function in a setting/calibrating mode of an electronic device comprising at least one actuatable selector, wherein the setting/calibrating of the feature or function requires an actuation of the at least one selector, wherein the electronic device comprises at least one indicator hand coupled to an actuation mechanism that rotates the at least one indicator hand in at least one of a clockwise and counterclockwise direction, wherein the method comprises the steps of:

using the at least one indicator hand to indicate the actuatable selector for actuation;

setting/calibrating the feature or function; and exiting the setting/calibration mode.

2. The method as claimed in claim 1, wherein the at least one indicator hand indicates the actuatable selector for actuation in a manner that is independent of an actuation sequence.

3. The method as claimed in claim 2, wherein the at least one indicator hand points to the actuatable selector for selecting.

4. The method as claimed in claim 2, wherein the at least one indicator hand indicates the actuatable selector for actuation by rotating in both a clockwise and counterclockwise direction proximate the selector for actuation.

5. The method as claimed in claim 1, wherein the setting/calibration of the feature or function requires N selector actuations, wherein the method comprises the steps of:

(a) using the at least one indicator hand to indicate a next selector for actuation;

(b) indicating a further next selector for actuation with the at least one indicator hand to effectuate the setting/calibration of the feature or function; and (c) returning to step (b) (N−2) times, wherein N≥2.

6. The method as claimed in claim 1, wherein the setting/calibration of the feature or function requires N selector actuations, and wherein the electronic device comprises at least a second indicator hand coupled to an actuation mechanism that rotates the at least second indicator hand in at least one of a clockwise and counterclockwise direction, wherein the method comprises the steps of:

(a) using the at least second indicator hand to indicate a next selector for actuation;

(b) indicating a further next selector for actuation with the at least one indicator hand or second indicator hand to effectuate the setting/calibration of the feature or function;

(c) returning to step (b) (N−3) times, wherein N≥3.

7. An electronic device comprising at least one actuatable selector, wherein a setting/calibrating of a feature or function in the electronic device requires an actuation of the at least one selector, wherein the electronic device comprises at least one indicator hand coupled to an actuation mechanism that rotates the at least one indicator hand in at least one of a clockwise and counterclockwise direction; and a controller operatively coupled to the actuation mechanism and the at least one actuatable selector for causing the at least one indicator hand to rotate in at least one of a clockwise and counterclockwise direction, and wherein the controller carries out the setting/calibrating of the feature or function step as claimed in claim 1.

8. The electronic device as claimed in claim 7, wherein the electronic device comprises at least a second indicator hand coupled to an actuation mechanism that rotates the at least second indicator hand in at least one of a clockwise and counterclockwise direction, and wherein a next selector for actuation is indicated by the at least second indicator hand, and a further next selector is indicated for actuation with the at least one indicator hand or second indicator hand to effectuate the setting/calibration of the feature or function.

* * * * *